United States Patent [19]

Maile

[11] Patent Number: 4,650,986

[45] Date of Patent: Mar. 17, 1987

[54] ELECTRICAL CONTROL HAVING AUTOMATIC MODE SELECTION

[75] Inventor: Donald W. Maile, Lancaster, Pa.

[73] Assignee: RCA Corporation, Princeton, N.J.

[21] Appl. No.: 759,294

[22] Filed: Jul. 26, 1985

[51] Int. Cl.[4] ..... G08B 13/18

[52] U.S. Cl. ..... 250/214 SW; 250/221; 340/567

[58] Field of Search ..... 250/214 R, 214 SW, 206, 250/221, 222.1; 340/565, 567, 527, 528; 307/117, 311, 112; 328/2; 361/139

[56] References Cited

U.S. PATENT DOCUMENTS

| | | | |
|---|---|---|---|
| 3,703,718 | 11/1972 | Berman | 340/258 |
| 3,958,118 | 5/1976 | Schwarz | 250/221 |
| 4,179,691 | 12/1979 | Keller | 340/567 |
| 4,342,987 | 8/1982 | Rossin | 340/567 |
| 4,344,071 | 8/1982 | Allen | 340/566 |
| 4,346,427 | 8/1982 | Blisset et al. | 361/173 |
| 4,364,030 | 12/1982 | Rossin | 340/567 |
| 4,377,808 | 3/1983 | Kao | 340/527 |
| 4,647,788 | 2/1987 | Maile et al. | 307/117 |
| 4,618,770 | 3/1985 | Maile | 250/338 |

OTHER PUBLICATION

Exhibit A, Schematic Diagram, two pages.

*Primary Examiner*—David C. Nelms
*Assistant Examiner*—S. Allen
*Attorney, Agent, or Firm*—Joseph S. Tripoli

[57] ABSTRACT

A mode control circuit is particularly useful in controlling the operation of an passive infrared appliance switch. When power is first applied to the control, a first output signal is emitted which places the switch in one mode of operation. If the power is then removed and reapplied within a short time, the control emits a second output signal placing the switch in a second mode of operation. However, if the power is removed for a long enough time, the control will emit the first signal when the power is reapplied.

7 Claims, 2 Drawing Figures

ELECTRICAL CONTROL HAVING AUTOMATIC MODE SELECTION

The present invention relates to electrical controls, and specifically to circuits for such controls which place the control in different states depending upon the sequence of application of power to the circuit.

BACKGROUND OF THE INVENTION

Passive infrared detectors have been used to control lights and other electrical appliances. Such devices detect the change in the infrared radiation (heat) within an area and activate the electrical appliance or sound an intrusion alarm. Typically, the change in heat results from a person entering or moving within the sensing area. The appliance remains turned on for a predetermined period of time after which, if no further change in the infrared pattern has occured, the appliance goes off.

One such device is described in my U.S. patent application Ser. No. 714,510 filed on Mar. 21, 1985. That device includes a single pole-double throw switch with a center off position which is typically mounted on the enclosure containing the IR detector electronics. This switch selects one of two modes of operation: (1) automatic, with the IR detector controlling the appliance, or (2) the always-on mode, in addition to an off state.

It is desired to use this type of device to control an electric light which is hardwired in a home, such as an outdoor porch light. Such a light is typically controlled by a single pole-single throw wall switch or two "3-way" switches inside the house. If the IR device is to be added to an existing porch light, the mode control switch would be located outside and the existing wall switch would merely turn the device on and off with no mode control. The operator would have to go outside to select between the automatic and always-on mode. To substitute the mode control switch for the wall switch would require running additional wires. This substitution would not be possible in a "3-way" circuit.

The present invention povides an improved electrical controller that permits the mode control from existing building switches and wiring.

SUMMARY OF THE INVENTION

A circuit for controlling an electrical device, such as an infrared operated switch, has a section which emits a first signal upon the application of power to the circuit. This section of the circuit emits a second signal if the power is removed and restored within a given interval of time. If the power is restored after this interval, the circuit section emits the first signal.

DETAILED DESCRIPTION OF THE INVENTION

Figure 1:
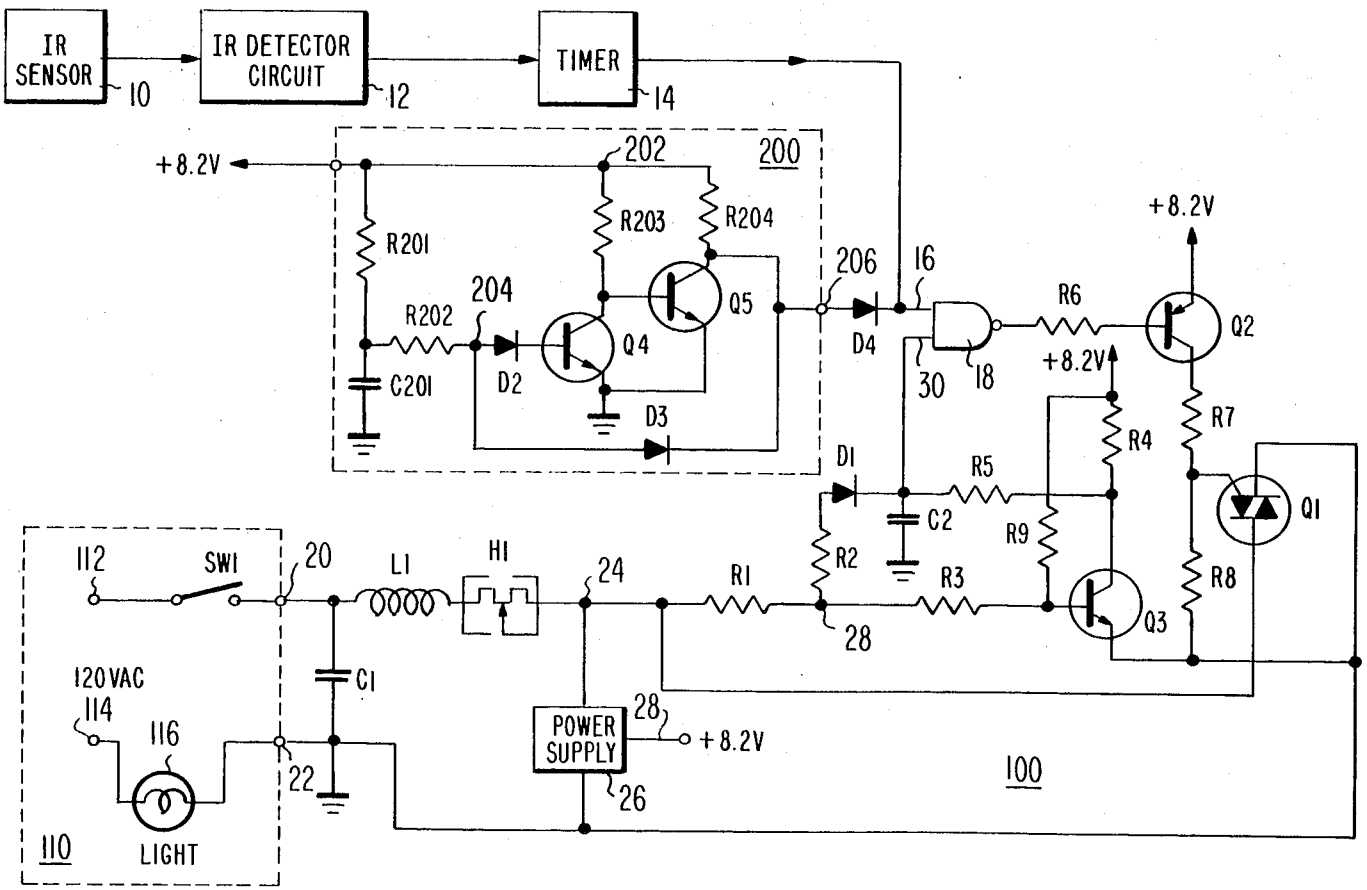
FIG. 1 is a schematic circuit diagram of an electrical appliance switch incorporating the present invention.

With initial reference to FIG. 1, an infrared operated appliance switch 100 comprises sensor 10 which responds to infrared radiation (IR) impinging upon it. Sensor 10 is connected to infrared detector circuit 12, which responds to changes in the infrared radiation sensed by the sensor and emits an output signal upon the detection of such changes. The circuit is so designed that it will respond to relativey fast changes in the infrared radiation, such as those emitted by a person entering the range of the sensor 10; as opposed to relatively slow changes in infrared radiation, such as those derived from the solar heating of the sensor area. Although those of ordinary skill in the art will easily recognize that any of a number of circuits may be used for detector circuit 12, one such circuit is shown in my aforementioned U.S. Patent Application.

The output signal of the detector circuit 12, representing sudden changes in the detected infrared radiation, triggers a timer circuit 14 which emits a high level output signal for a given amount of time upon receipt of the signal from the detector circuit. The output of the timer 14 is coupled to one input terminal 16 of a dual input NAND gate 18.

The infrared light switch 100 may be used to control an electrical circuit 110 within a house, for example. In this case 120 volt alternating current is applied across terminals 112 and 114 of the house circuit. Terminal 112 is connected to a wall switch SW1 having another terminal connected to power terminal 20. Terminal 114 has one lead of an electric light 116 connected to it, with the other lead of the light being connected to power terminal 22. In a conventional household circuit such as circuit 110 where the infrared switch is not being used, power terminals 20 and 22 would be connected together so that switch SW1 would directly control the operation of light 116. When the infrared switch 100 is connected to the household circuit 110, as is shown in FIG. 1, the infrared switch 100 is in series with switch SW1 and both switches must be in a conductive state in order for the light 116 to be turned on.

Capacitor C1 is connected across the terminals 20 and 22. An RF filter inductor L1 and a thermal circuit breaker H1 are connected in series between terminal 20 and node 24. A low voltage power supply 26 is connected between node 24 and power terminal 22 providing a low positive voltage (+8.2 volts) with respect to the circuit ground at terminal 22 at output terminal 28. One conducting, or main, terminal of a triac Q1 is connected to node 24 and the other conducting terminal is connected to the system ground at terminal 22. Triac Q1 is mounted on a heat sink (not shown) with circuit breaker H1. The heat sink is sized so that the thermal circuit breaker H1 will trip before the maximum current rating of the triac Q1 is exceeded.

Resistors R1 and R3 are connected in series between node 24 and the base of an NPN transistor Q3. The emitter of transistor Q3 is directly connected to the system ground and the collector is coupled through resistor R4 to the positive voltage supply at terminal 28. Bias resistor R9 couples the positive voltage supply to the base of transistor Q3. Resistor R2 couples the anode of diode D1 to node 28 between resistors R1 and R3. The cathode of diode D1 is connected to the other input terminal 30 of the NAND gate 18 and capacitor C2 extends between the system ground and the other terminal 30. Resistor R5 couples terminal 30 to the collector of transistor Q3.

The output of NAND gate 18 is connected through resistor R6 to the base of a PNP transistor Q2 having its emitter coupled to the positive voltage supply. The collector of transistor Q2 is connected through the series connected resistors R7 and R8 to the system ground. The node between transistors R7 and R8 is connected to the gate of triac Q1. In order for the triac Q1 to turn ON both input signals to NAND gate 18 must be high.

The infrared light switch 100 includes a mode control circuit 200 for placing the switch either in an automatic mode, in which case the sensed infrared radiation controls the operation of the electric light 116, or in a second mode, in which the light 116 is always on regardless of changes in infrared radiation. The positive 8.2 volts from the power supply 26 is applied to node 202. Resistor R201 and capacitor C201 are connected in series between node 202 and the system ground. Resistor R202 couples the node between resistor R201 and capacitor C201 to node 204. Diode D2 has its anode connected to node 204 and its cathode connected to the base of an NPN transistor Q4. The collector of transistor Q4 is coupled through resistor R203 to node 202 and is also directly coupled to the base of a NPN transistor Q5. The collector of transistor Q5 is connected through resistor R204 to node 202 and the emitters of both transistors Q4 and Q5 are directly connected to the system ground. The collector of transistor Q5 is coupled to the output terminal 206 of the mode control circuit 200. The anode of diode D3 is connected to node 204 and its cathode is connected to the collector of transistor Q5. Diode D4 has its anode connected to the mode control output terminal 206 and its cathode connected to the first input terminal 16 of NAND gate 18.

The operation of the infrared switch 100 will now be described. Assuming for the moment that the IR pattern in the area of the IR sensor is unchanging. When switch SW1 closes, power will be applied to the infrared switch 100 but because triac Q1 is in series with switch S1 and light 116, the full 120 volts AC will not be applied across the terminals of light 116 and, therefore, it will not illuminate. The relatively small current flowing through the light via a path through the power supply 26 will be too small to cause the light to glow.

If the first input 16 of the NAND gate 18 is now held high, the triac Q1 will be triggered by high levels in the signal applied to the other input terminal 30. This terminal 30 receives signals from two sources. One source is from the AC line through resistors R1 and R2 and diode D1. The values of these components cause terminal 30 to reach its threshold when the incoming line voltage across terminals 112 and 114 is above a given positive value, for example seventy volts. At this time, the output of NAND gate 18 goes low, turning on transistor Q2 which turns on the triac Q1, applying the remainder of the positive half cycle of the AC line voltage to the light 116.

The other input signal source to terminal 30 of the NAND gate is form the collector of transistor Q3. The collector is normally at nearly zero volts due to current flowing through resistor R9 biasing the base and causing saturation of transistor Q3. When the incoming AC line voltage reaches a negative threshold value, for example minus sixty-five volts, transistor Q3 turns off, causing its collector to go to a positive voltage. The collector level is coupled to terminal 30 of NAND gate 18 through a time delay circuit provided by resistor R5 and capacitor C2. Because of the collector signal time delay, terminal 30 reaches its threshold approximately fifty microseconds after the collector of transistor Q3 goes positive. At this time the output of NAND gate 18 goes low turning on transistor Q2 and therefore triac Q1, applying the remainder of the negative half cycle of the AC line voltage to the light 116.

Therefore, the triac Q1 is triggered during various portions of each half cycle of the line current as long as the signal at input terminal 16 is high. The input at terminal 16 is dependent upon the outputs from timer 14 and the mode control circuit 200. When the power is first applied to the IR switch 100 by the closing of switch SW1, the positive 8.2 volts from power supply 26 is applied to node 202 of mode control 200. Assumming that the power has been off for some time, capacitor C201 will be fully discharged. Therefore, when the wall switch SW1 closes, capacitor C201 will slowly charge to approximately half of the supply voltage (about 4 volts). The voltage on the base transistor Q4 will slowly rise so that the transistor will not turn on immediately upon the application of power to the circuit 100. However, since there is no RC network in the base circuit of transistor Q5, the positive voltage will be applied through resistor R203 to the base of Q5 quickly turning it on and clamping its collector to ground. With the collector of Q5 at ground potential, the output terminal 206 will also be at ground potential which will reverse bias diode D4 rendering it noncondutive. In addition, node 204 is coupled through diode D3 to the ground potential at the collector of Q5. Therefore, even as capacitor C201 begins to charge, the base of Q4 will remain at approximately ground potential and never turn on the transistor.

With the mode control switch 200 providing a ground potential at its output terminal 206, the input at terminal 16 will vary with the signal from the output of timer 14. Therefore, when the power is initially applied, infrared switch 100 will be in the automatic mode with the triac Q1, and hence, the light 116 being controlled by the sensed infrared radiation.

When the infrared switch is in the automatic state, if the wall switch SW1 is turned off for a few seconds, the voltage at terminal 28 of the power supply 26 will go to zero volts. However, the component values of the mode control 200 are selected so that capacitor C201 will discharge at a relatively slower rate than the supply voltage at terminal 28. Therefore, if the wall switch SW1 is turned on again before capacitor C201 has signifcantly discharged but after the power supply has gone to zero volts or so, the base of Q4 will be biased on by the existing charge of capacitor C201. In this case, upon the reapplication of the power by the closure of switch SW1, Q4 being biased on will ground the base of transistor Q5 preventing it from turning on. With transistor Q5 biased off, the output terminal 206 will be at a high potential which when applied through diode D4 to NAND gate 18 will turn on the light 116 during portions of the positive and negative half cycles of the AC line voltage. The mode control 200 in this state clamps terminal 16 of NAND gate 18 to a high potential regardless of the output level from timer 14 thereby overriding the output of the infrared detector circuit 12 and timer 14 and putting the light in an always-on mode.

In the always-on mode, if the wall switch SW1 is opened for a long enough time so that the power supply voltage goes to zero and capacitor C201 substantially discharges, the infrared switch 100 will be restored to its initial condition such that upon the next closure of SW1, the IR switch 100 will come up in the automatic mode.

Figure 2:
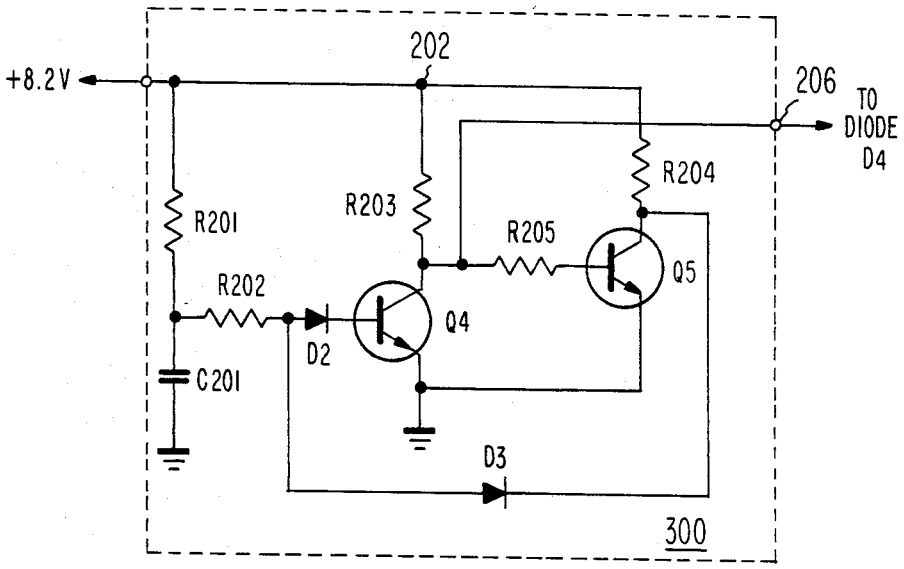
FIG. 2 is another embodiment of a portion of the FIG. 1 circuit.

FIG. 2 shows an alternative embodiment for the mode control circuit 200 so that the infrared switch 100 will initially come up in the always-on mode rather than the automatic mode of operation. Mode control circuit 300 of FIG. 2 is essentially the same as circuit 200 of FIG. 1, except that the output line to the diode D4 has been moved from the collector of Q5 to the collector of Q4. In addition, resistor R205 has been inserted between the collector of Q4 and the base of transistor Q5.

The operation of the transistors in mode circuit 300 is identical to that of the circuit 200. That is when power is initially applied to the circuit, transistor Q4 will remain off while transistor Q5 turns on immediately, clamping its collector to ground. With the collector of Q5 at ground, the base of transistor Q4 will also be substantially at ground potential preventing the latter transistor from turning on. Therefore, in this state the collector of transistor Q4 will be at a positive potential which is coupled to the output terminal 206 holding the terminal 16 of NAND gate 18 to a high potential and placing the switch 100 in the always-on mode.

From the always-on state if the wall switch SW1 of FIG. 1 is turned off for a brief interval so as to allow the proper supply voltage to go to substantially zero yet not long enough to fully discharge capacitor C201, when the power is restored transistor Q4 will be turned on. This clamps the collector of transistor Q4 to ground potential, which prevents transistor Q5 from turning on. With Q4 turned on the ground potential is coupled to terminal 206 permitting the input at terminal 16 of NAND gate 18 to vary depending upon the output from timer 14. In this state the infrared switch 100 is in the automatic mode. As with the embodiment in FIG. 1 if the house switch SW1 is opened for a sufficiently long interval to allow capacitor C201 to fully discharge, mode control 300 will be placed in the initial state upon the reapplication of power, causing mode control 300 to bring the infrared switch 100 into the always-on mode.

Although the present invention has been described in the context of an IR light switch, it has broad application to a wide variety of electrical devices where one wishes to control the device operation by the sequence in which power is applied to the device.

I claim:

1. A circuit for controlling the operation of an electric device comprising:

means for emitting a first signal upon the initial application of power to the circuit; and means for emitting a second signal if the power is removed and then reapplied to said circuit within a given interval of time, if the power is reapplied to the circuit after the given interval the first signal is emitted.

2. The circuit as in claim 1 wherein the means for emitting a first signal comprises:

a first transistor having collector and emitter electrodes defining the ends of a conduction path, and having a base electrode;

means coupled to said first transistor and responsive to the initial application of power to the circuit for causing said conduction path to be rendered conductive; and means coupled to one electrode of said first transistor for providing said first signal.

3. The circuit as in claim 2 wherein the means for emitting a second signal comprises:

a second transistor having collector and emitter electrodes defining a conduction path, and having a base electrode; and means coupled to the base electrode of said second transistor for causing said second transistor conduction path to be rendered conductive when said power is removed from said circuit, after said initial application, and then reapplied to said circuit within said given interval of time;

whereby said second signal is provided by said means coupled to said one electrode of said first transistor.

4. The circuit as in claim 1 further comprising:

first and second terminals; and wherein said means for emitting a first signal comprises:

a first transistor having collector and emitter electrodes defining the ends of a conduction path, and having a base electrode;

a first resistor connected in series with the conduction path of the first transistor, this series connection extending between the first and second terminals, a first node being formed between the first transistor conduction path and the first resistor; and wherein said means for emitting a second signal comprises:

a second transistor having collector and emitter electrodes defining the ends of a conduction path, and having a base electrode;

a second resistor connected in series with the conduction path of the second transistor, this series connection extending between the first and second terminals, a second node being formed between the second transistor conduction path and the second resistor, the base of the first transistor being coupled to said second node;

a network including at least one resistor and a capacitor connected between said first and second terminals and to the base of the second transistor; and a diode extending between the first node and said network.

5. The circuit as in claim 4 wherein the resistor-capacitor network comprises:

a third resistor having two leads, one of which being connected to the first terminal;

a capacitor connected between the other lead of the third resistor and the second terminal; and a fourth resistor having a first lead connected to the other lead of the third resistor, and having a second lead coupled to the base of the second transistor and to the diode.

6. An infrared responsive electrical control circuit comprising:

an infrared radiation sensor;

means coupled to said sensor for emitting an output signal in response to changes in infrared radiation intensity being detected by said sensor;

first means for generating a control signal responsive to said output signal upon the initial application of power to the circuit; and a second means for generating said control signal regardless of said output signal if the power is removed and then reapplied to the control circuit within a given interval of time, if the power is reapplied after the given interval the control signal is generated by said first means only.

7. The infrared responsive electrical control circuit comprising:

an infrared radiation sensor;

means coupled to said sensor for emitting an output signal in response to changes in infrared radiation intensity being detected by said sensor;

first means for generating a control signal regardless of said output signal upon the initial application of power to the circuit; and a second means for generating said control signal responsive to said output signal if the power is removed and then reapplied to the control circuit within a given interval of time, if the power is reapplied after the given interval the control signal is generated by said first means only.

* * * * *